US010717128B2

(12) United States Patent
Rappart et al.

(10) Patent No.: US 10,717,128 B2
(45) Date of Patent: Jul. 21, 2020

(54) METHOD FOR MANUFACTURING A COMPONENT USING THE LOST-WAX CASTING METHOD WITH DIRECTED COOLING

(71) Applicant: SNECMA, Paris (FR)

(72) Inventors: Yvan Rappart, Moissy-Cramayel (FR); Christelle Berthelemy, Moissy-Cramayel (FR); Benoît Georges Jocelyn Marie, Moissy-Cramayel (FR); David Locatelli, Moissy-Cramayel (FR); Sébastien Digard Brou De Cuissart, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 81 days.

(21) Appl. No.: 14/760,559

(22) PCT Filed: Jan. 13, 2014

(86) PCT No.: PCT/FR2014/050061
§ 371 (c)(1),
(2) Date: Jul. 13, 2015

(87) PCT Pub. No.: WO2014/111648
PCT Pub. Date: Jul. 24, 2014

(65) Prior Publication Data

US 2015/0352634 A1 Dec. 10, 2015

(30) Foreign Application Priority Data

Jan. 17, 2013 (FR) ..... 13 50424

(51) Int. Cl.
*B22D 27/04* (2006.01)
*B22C 9/04* (2006.01)
(Continued)

(52) U.S. Cl.
CPC ..... *B22D 27/04* (2013.01); *B22C 7/02* (2013.01); *B22C 9/04* (2013.01); *B22C 9/12* (2013.01);
(Continued)

(58) Field of Classification Search
CPC .. B22C 9/04; B22C 9/043; B22C 9/12; B22C 9/10; B22C 9/108; B22D 27/04; B22D 27/045
(Continued)

(56) References Cited

U.S. PATENT DOCUMENTS 2,756,475 A * 7/1956 Hanink ..... B22C 9/04 164/30
3,659,645 A * 5/1972 Rose ..... C30B 11/002 164/353
(Continued)

FOREIGN PATENT DOCUMENTS

CN 102169518 A 8/2011
GB 1 377 042 A 12/1974
(Continued)

OTHER PUBLICATIONS

International Search Report dated Jun. 4, 2014, issued in corresponding International Application No. PCT/FR2014/050061, filed Jan. 13, 2014, 2 pages.
(Continued)

*Primary Examiner* — Kevin E Yoon
*Assistant Examiner* — Jacky Yuen
(74) *Attorney, Agent, or Firm* — Christensen O'Connor Johnson Kindness PLLC

(57) ABSTRACT

A method for manufacturing a metal component using lost-wax casting is provided. The component is made of, for example, nickel alloy, with a columnar or monocrystalline structure with at least one cavity of elongate shape. The
(Continued)

method includes creating a wax model of the component with a ceramic core corresponding to the cavity, creating a shell mold around the model, placing the mold in a furnace, with the base standing on the sole of the furnace, pouring molten alloy into the shell mold, solidifying the poured metal by gradual cooling from the sole in a direction of propagation.

18 Claims, 2 Drawing Sheets

(51) Int. Cl.

| | |
|---|---|
| ***B22C 9/10*** | (2006.01) |
| ***B22C 7/02*** | (2006.01) |
| ***B22C 9/22*** | (2006.01) |
| ***B22C 9/12*** | (2006.01) |
| ***B22C 21/14*** | (2006.01) |

(52) U.S. Cl.
CPC ..... *B22C 9/22* (2013.01); *B22C 21/14* (2013.01); *B22D 27/045* (2013.01)

(58) Field of Classification Search
USPC ..... 164/122.1, 122.2, 137, 340, 350–351, 164/365–366, 370
See application file for complete search history.

(56) References Cited

U.S. PATENT DOCUMENTS

| | | | | |
|---|---|---|---|---|
| 3,722,577 | A * | 3/1973 | Webb | B22C 21/14 164/30 |
| 4,532,974 | A | 8/1985 | Mills et al. | |
| 4,714,101 | A * | 12/1987 | Terkelsen | C30B 11/14 164/122.2 |
| 5,611,389 | A | 3/1997 | Alessandri et al. | |
| 6,364,001 | B1 * | 4/2002 | Cross | B22C 9/043 164/122.1 |
| 7,231,955 | B1 | 6/2007 | Bullied et al. | |
| 2005/0211408 | A1 * | 9/2005 | Bullied | B22D 27/045 164/122.2 |

FOREIGN PATENT DOCUMENTS

| | | | |
|---|---|---|---|
| JP | H05138296 | A | 6/1993 |
| JP | 2007203371 | A | 8/2007 |
| SU | 295603 | A | 11/1971 |
| SU | 606 676 | A1 | 5/1978 |

OTHER PUBLICATIONS

Office Action dated Dec. 21, 2017, issued in corresponding Russian Application No. 2015128268, 10 pages.
Office Action dated Jan. 9, 2018, issued in corresponding Japanese Application No. 2015-553146, 5 pages.

* cited by examiner

METHOD FOR MANUFACTURING A COMPONENT USING THE LOST-WAX CASTING METHOD WITH DIRECTED COOLING

TECHNICAL FIELD

The present invention relates to the field of metal components, such as turbine engine blades obtained by casting metal in a shell mould, and relates to a method for manufacturing these components with directed solidification of the columnar or monocrystalline type.

PRIOR ART

The method for manufacturing metal components by lost-wax casting comprises a succession of steps stated below. Models of components to be manufactured are first of all produced in wax or another temporary material. Where applicable the models are joined in a cluster around a central barrel also made from wax. A shell made from ceramic material is then formed on the models thus assembled by successive soakings in slips of suitable composition comprising particles of ceramic materials in suspension in a liquid, alternated with sprinklings of refractory sand. The wax model is then eliminated while consolidating by heating the shell mould thus formed. The following step consists of pouring a molten metal alloy, in particular a nickel superalloy, into the shell mould and then cooling the components obtained so as to direct the solidification thereof according to the desired crystalline structure. After solidification, the shell is eliminated by knocking out in order to extract the components therefrom. Finally, the finishing steps are carried out in order to eliminate the excess material.

The cooling and solidification step is therefore controlled. The solidification of the metal alloy being the change from the liquid phase to the solid phase, directed solidification consists of progressing the growth of "nuclei" in the bath of molten metal in a given direction, avoiding the appearance of new nuclei by controlling the thermal gradient and the solidification rate. Directed solidification may be columnar or monocrystalline. Columnar directed solidification consists of orienting all the grain joints in the same direction, so that they do not contribute to the propagation of cracks. Monocrystalline directed solidification consist of totally eliminating grain joints.

Directed columnar or monocrystalline solidification is carried out in a manner known per se by placing the shell mould, open at its bottom part, on a cooled hearth and then introducing the assembly into heating equipment capable of maintaining the ceramic mould at a temperature above the liquidus of the alloy to be cast. Once the casting has been carried out, the metal situated in openings provided at the bottom of the shell mould solidifies almost instantaneously in contact with the cooled hearth and is solidified over a limited height of around one centimetre, over which it has an equi-axial granular structure, that is to say its solidification over this limited height takes place naturally without any favoured direction. Above this limited height, the metal remains in the liquid state because of the external heating imposed. The hearth is moved at a controlled rate downwards so as to extract the ceramic mould from the heating device, leading to a gradual cooling of the metal, which continues to solidify from the bottom part of the mould to its top part.

Columnar directed solidification is obtained by maintaining a suitable temperature gradient in terms of quantity and direction in the liquid-solid phase change region, during this operation of movement of the hearth. This makes it possible to prevent overfusion giving rise to new nuclei in front of the solidification front. Thus the only nuclei that allow the growth of grains are those that pre-exist in the equi-axial region solidified in contact with the cooled hearth. The columnar structure thus obtained consists of a set of narrow elongate grains.

Monocrystalline directed solidification further comprises the interposing, between the component to be cast and the cooled hearth, of either a baffle or grain selector, or a monocrystalline nucleus; the thermal gradient and the solidification rate are controlled so that new nuclei are not created in front of the solidification front. The result is a monocrystalline cast component after cooling.

This directed solidification technique, whether columnar or monocrystalline, is commonly used for producing cast components, and in particular turbine engine blades, when it is desirable to confer particular mechanical and physical properties on the cast components. This is in particular the case when the cast components are turbine engine blades.

In addition, as is known per se, when a lost-wax casting method is used, with or without directed solidification, feeders are used in order to eliminate porosity defects in end regions of the components to be manufactured. In practice, excess volumes are provided when wax models are produced, which are placed against the regions of the components that are liable to have porosity defects after solidification. When the shell is produced, the excess volumes result in additional volumes inside the shell and are filled with molten metal during casting, in the same way as the other parts of the shell. The feeders are reserves of solidified metal that fill the additional volumes in the shell. The porosity defects, when they occur, are then moved into the feeders and are no longer located in the manufactured components themselves. Then, once the metal has solidified and cooled, the feeders are removed during a component finishing operation, for example by machining, cutting or grinding.

A method for manufacturing monocrystalline blades, such as turbine nozzles, consisting of at least one vane between two platforms transverse with respect to the generatrices of the vane, is also known, as described in the patent FR 2724857 in the name of the applicant. The method is of the type according to which the mould is supplied with molten metal at its top part. Directed solidification is carried out, the front of which progresses vertically from bottom to top, and a single crystal grain is selected by means of a selection device placed at the bottom part of the mould and at the outlet from which there is a single grain of predetermined orientation and with a direction merging with the vertical.

The present invention relates to the manufacture of components having at least one cavity and the wax model of which is cast around a ceramic core. This core, when the molten metal is poured, reserves inside the component the volume corresponding to the required cavity. For a turbine engine blade, the cavities through which the cooling fluid passes are produced in this way.

The ceramic cores for turbine engine blades comprise, according to a known manufacturing method, two holding spans or lugs, one at each longitudinal end. The models are prepared so that an embedding or anchoring of the ceramic core is defined at the region of the base of the core in the top part of the mould. This is because, according to this technique, the core and the wax model are mounted with a base at the top and the apex at the bottom. Thus, after the ceramic casting operations, the ceramic shell formed locks the core in this region. During casting, the molten metal fills the cavity released by the wax that has previously been eliminated. The molten metal occupies the space between the core and the wall of the shell. Solidification is then operated by pulling downwards the hearth of the furnace on which the shell is placed, and the solidification progresses from the starter in which several metal grains solidify and then successively in the top of the blade, the vane and the root. In solidifying the metal creates a second anchoring of the core at the end span in the part where solidification starts. The core is then held at both ends and is stressed under compression. The result is a deformation of the core by buckling. The core no longer complies with its theoretical position and defects may appear on the component: metal wall thicknesses may no longer be complied with, or the core, under the effect of the stresses of the two embeddings at its two ends, perforates the metal wall of the blade by buckling. In these two cases the component must the scrapped.

Moreover, the positioning of the embedding at the start of solidification has the drawback of disturbing the solidification front arising, with the risk of generating parasitic grains or disorientation. Furthermore, there exists, in the case of the monocrystal, a risk of a defect of reattachment of the growing edges on either side of the embedding region.

DISCLOSURE OF THE INVENTION

The subject matter of the invention is therefore a method for manufacturing a component that overcomes the problems presented above.

The method according to the invention for manufacturing, using the lost-wax casting method, a metal component made from nickel alloy, with a columnar or monocrystalline structure with at least one elongate-shaped cavity, comprising the following steps for producing a wax model of the component with a ceramic core corresponding to said cavity, the ceramic core comprising a first holding span at a longitudinal end and a second holding span at the opposite end;

producing a shell mould around the model, the mould comprising a base and the first span of the core being on the same side as the base, placing the mould in a furnace, the base being placed on the hearth of the furnace, pouring said molten alloy into the shell mould, directed solidification of the poured metal by gradual cooling from the hearth in a propagation direction, is characterised in that the core is secured to the shell mould by a means for anchoring between the first span of the core and the wall of the mould, the second span of the core being held in the mould by a holding means sliding over the wall of the mould.

The solution of the invention avoids the deformation of the core during the progression of the directed solidification since the core is not held by anchoring at its two ends. It is thus not put under compression by the forces that would result from the difference in the coefficients of expansion between the mould and the core. There is moreover no risk of the generation of parasitic grains or defects of reattachment of the main grain.

The solution of the invention also guarantees the position of the core during the entire phase of manufacture of the component, from the wax model to the casting and solidification of the component.

Advantageously, the anchoring means comprises a rod, more particularly made from refractory ceramic, alumina for example, passing through the first span and the wall of the mould. Preferably, the ceramic rod has a small diameter of around one millimetre. The rod passes through the wax model and the core, which have previously been pierced at a diameter slightly greater than that of the rod in order to avoid stresses being caused at this level.

In accordance with another feature, the sliding holding means is formed by a space formed between the span and the wall of the mould, this space being obtained by means of a film of expansion varnish deposited on the surface of the span when the model is produced. This varnish is then eliminated during the mould-dewaxing operation. It is for example a material of the nail varnish type making it possible to obtain thicknesses of a few hundredths of a millimetre per layer. A varnish suitable for this application comprises solvents, resin, nitrocellulose and plasticisers. For example, a varnish such as the "Thixotropic base" sold under the trade name: "All formulae Peggy Sage nail polish" can be used in the method of the present invention.

This film is more precisely interposed between the second span and the wall of the mould. It is applied, before the shell mould is formed, to the surfaces of the second span that are parallel to the direction of the progression of the cooling; that is to say, in the case of a movable hearth, parallel to the direction of pulling of the movable hearth. This film of varnish is preferably very thin, around 3 to 5 hundredths of a millimetre. Its purpose is to prevent firstly the wall of the mould sticking to the core at this region and secondly to create a thin free space, after dewaxing, to permit longitudinal guiding of the second span with respect to the mould and prevent the mould from exerting a stress on the core.

The surfaces of the second span that are not parallel to the axis of the progression of the solidification, i.e. the pulling axis, are covered initially by a deposit of wax so as to provide, after dewaxing, a space between said surfaces of the second span and the wall of the mould. This space, during the pouring of molten metal, prevents contact between the wall of the shell and the second span of the core, and prevents the stressing of the core in this region during solidification. Typically, the thickness of this deposit of wax is around one millimetre for components having a length of 100 to 200 mm, that is to say approximately 1% of the length of the component.

The method allows the simultaneous manufacture of a plurality of components. The models for said components are in this case collected together in a cluster inside a shell mould.

The method applies to the manufacture of at least one metal part with a columnar structure, a means for germinating the crystalline structure being provided between the mould and the furnace hearth.

The method applies to the manufacture of at least one component with a monocrystalline structure, a grain selector being provided between the nucleation element and the mould.

The invention applies in particular to the manufacture of a turbine engine blade, the first span being in the extension of the apex of the blade vane, the second span being in the extension of the root of the blade.

The method advantageously uses a furnace, the hearth of which is able to move vertically between a hot region where the metal is molten and a cold region for solidification of the metal, the hearth itself being cooled.

BRIEF DESCRIPTION OF THE FIGURES

Other characteristics and advantages will become apparent from the following description of an embodiment of the invention given by way of non-limitative example with reference to the accompanying drawings, on which

DESCRIPTION OF AN EMBODIMENT OF THE INVENTION

The present invention relates to a method for manufacturing metal components made from a nickel-based alloy for obtaining, by means of a suitable directed solidification, a columnar or monocrystalline crystalline structure.

Figure 1:
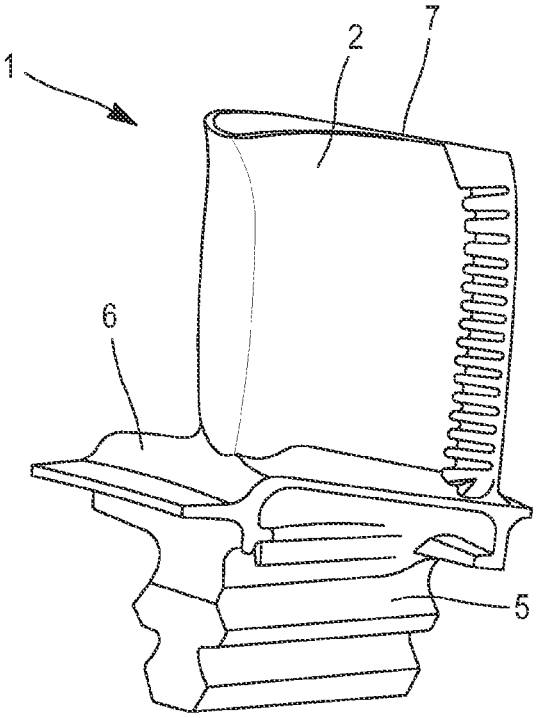
FIG. 1 depicts a turbine engine blade that can be obtained according to the method of the invention.

The invention relates more particularly to the manufacture of turbine engine blades like the one shown in FIG. 1; a blade 1 comprises a vane 2, a root 5 for attachment thereof to a turbine disc, and an apex 7 with a heel where applicable. Because of the operating temperatures of the turbine engine, the blades are provided with an internal cooling circuit through which a cooling fluid travels, generally air. A platform 6 between the root and the vane constitutes a portion of the radially inner wall of the gas stream. The component depicted here is a movable blade but the invention also applies to a distributor or to any other component having a core.

Because of the complexity of the cooling circuit inside the component, it is advantageous to produce it by lost-wax casting with a ceramic core for forming the cavities of the cooling circuit.

Figure 2:
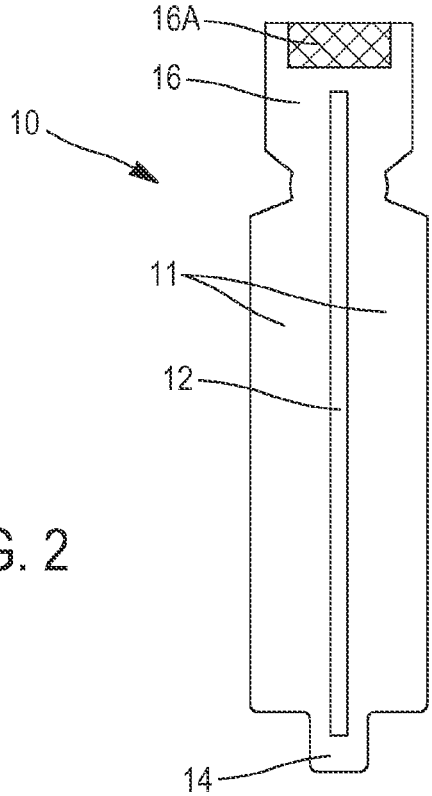
FIG. 2 depicts schematically a ceramic core for a turbine engine blade.
Figure 3:
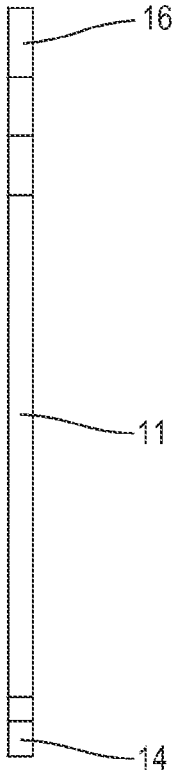
FIG. 3 depicts the core of FIG. 2 seen in profile.

FIGS. 2 and 3 depict schematically a core with a simplified form, made from ceramic, used for forming the internal cavities of a turbine engine blade. The elongate-shaped core 10 comprises a branch or a plurality of branches 11 separated by spaces 12 so as, after the pouring of the metal, to form the partitions between the cavities; in the example depicted, the core comprises two branches 11 separated by a space 12. At one end, the core is extended by a span or lug 14, the function of which is to hold the core during the manufacture of the component, but which does not necessarily correspond to a part of the component, once the latter is finished. At the opposite end the core comprises a second span 16 also for holding the core during the manufacturing steps. It can be seen in FIG. 3 that the core as depicted is relatively thin compared with its length. It will be understood that, the thinner the core with respect to its length, the more sensitive it will be to buckling.

Figure 4:
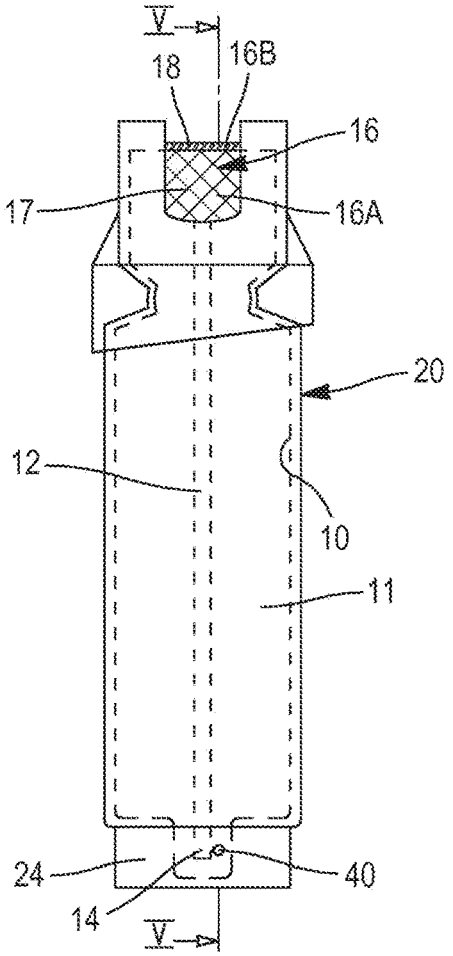
FIG. 4 depicts schematically a wax model with the core of FIG. 2; p

This core is placed in a mould for manufacturing the wax model. The cavity of this mould is in the shape of the component to be obtained. By injecting wax into this mould, the model of the component is obtained. The spans 14 and 16 are used for holding the core in the wax mould. FIG. 4 depicts schematically this wax model 20 with the core 10 in broken lines. The model extends at a first end 24 in the extension of the vane so as to cover the span 14 and at the opposite end 26 it extends at the root. It will be noted that a portion 16A of the span 16 is not covered with wax. This portion 16A comprises surfaces parallel to the axis of the core and is coated with a varnish, the function of which is explained below.

Several models are generally assembled in a cluster so as to manufacture several components simultaneously. The models are for example disposed in a drum in parallel around a vertical central cylinder and held by the ends. The bottom part is mounted on an element intended to provide the nucleation of the crystalline structure. The following step consists of forming a shell mould around the model(s). For this purpose, as is also known, the assembly is dipped in slips so as to deposit the refractory ceramic particles in successive layers. Finally, the mould is consolidated by heating and the wax eliminated by the dewaxing operation.

Figure 5:
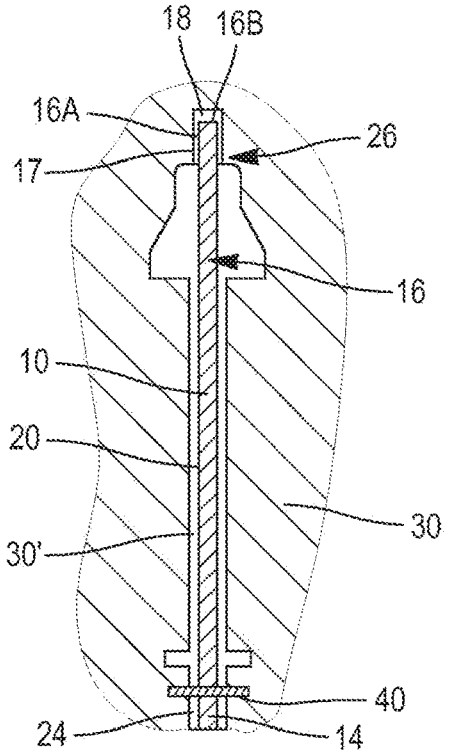
FIG. 5 depicts the shell mould seen in longitudinal section through the core.

FIG. 5 shows schematically, in longitudinal cross section, the arrangement of the invention between the core 10 and the shell 30 with regard to a single model 20.

The first span 14 is held in the mould 30 by a refractory ceramic rod 40 which passes through it and extends into the wall of the mould 30, being embedded therein. The rod 40 has been fitted before the shell mould was produced, after the model was pierced at the span 14. The piercing has a diameter slightly greater than that of the rod so that stresses are not created between the rod and the span and so that the rod provides correct positioning of the core in the model.

The second span 16, opposite to the first, is initially coated with a layer of varnish 17 on the part 16A of the core that is not covered with wax and which, after formation of the shell mould, comes into direct contact with the internal wall of the mould. After dewaxing of the mould, as can be seen in FIG. 5, the layer that has disappeared leaves a free space between the span 16 of the core and the wall of the shell mould. The reference 17 designates this free space left by the layer of varnish. This space 17 is thin, i.e. 3 to 5 hundredths of a millimetre. It forms a means for the sliding holding of the second span 16 on the wall of the shell 30.

Moreover, the surfaces—here the horizontal surface 16B—that are not parallel to the axis of the progression of the solidification are covered initially by a deposit of wax 18. This deposit of wax leaves a free space after dewaxing, with the same reference 18, which prevents the span 16 of the core coming into contact with the wall of the shell when the core expands. It thus prevents the stressing of the core. Typically, the thickness of this deposit of wax is approximately one millimetre for components having a length of 100 to 200 mm, that is to say approximately 1% of the length of the component.

By not being stressed the core is not liable to be buckled and the initial wall thicknesses of the component between the wall of the mould and the core are preserved.

FIG. 5 shows, in cross section along the component, the shell mould 30 and the core 10 inside the mould with the branches 11 and the spans 14 and 16. The cross section of the core is taken along the line VV in FIG. 4. The volume 30' corresponds to the wax of the model or, after solidification of the shell, to the space between the wall of the mould and the core to be filled by the metal. The rod 40 passes through the first span 14; it is sufficiently long to be anchored in the walls of the shell mould 30. In this way, the core 10 is positioned inside the shell mould 30.

Figure 6:
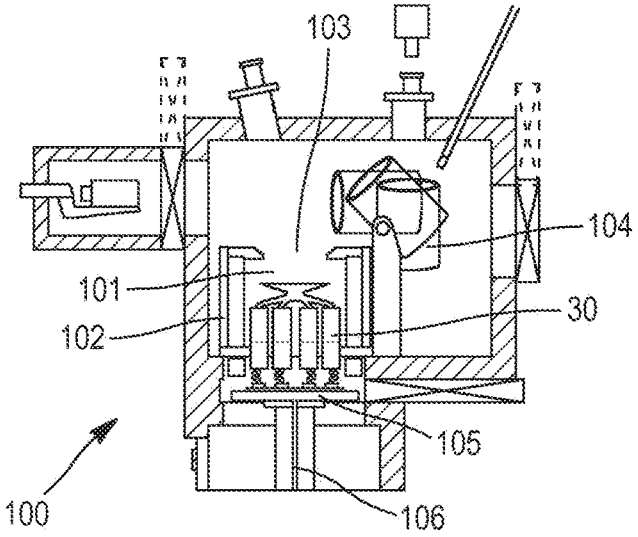
FIG. 6 depicts an example of a furnace which permits the directed solidification of molten metal in a shell mould.

After dewaxing and consolidation, the mould is placed on the hearth of a furnace equipped for directed solidification. Such a furnace 100 is shown in FIG. 6. A chamber 101 can be seen therein, provided with heating elements 102. An orifice 103 supplying molten metal communicates with a crucible 104 that contains the molten metal load and which, by tilting, fills the shell mould 30 disposed on the hearth 105 of the furnace. The hearth is able to move vertically, see the arrow, and is cooled by the circulation of water in a circuit 106 inside its plate. The mould is supported by its base on the cooled hearth. The bottom part of the mould is open onto the hearth through a nucleation member.

The manufacturing method as explained in the preamble of the application comprises the pouring of molten metal from the crucible 104 directly into the mould 30, which is maintained at a sufficient temperature to keep the metal melted, by the means 102 for heating the chamber 101, and where it fills the voids 30' between the core 10 and the wall of the mould 30. As the base of the mould is in thermal contact with the hearth through the nucleation element, the metal solidifies, forming a crystalline structure that propagates upwards. The hearth 105 is cooled continuously and is lowered gradually out of the heated chamber. In the case of a monocrystalline structure, a grain selector is interposed between the nucleation and the solidification, as is known per se.

Figure 7:
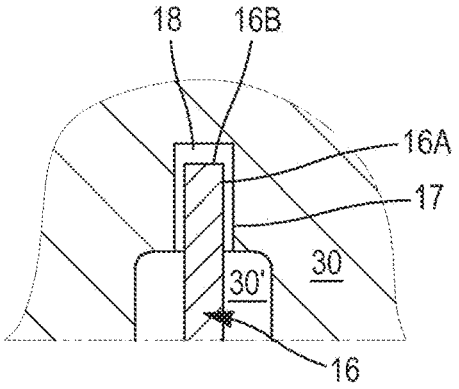
FIG. 7 is an enlarged view of the top end of the shell mould shown in FIG. 5.

The high temperature differences create stresses between the various regions of the mould with the metal. Through the arrangement of the invention and the rod 40, the core is held by anchoring the first span 14 solely in the lower solidification initialisation region. As can be seen in FIG. 7 the core is free to expand differentially in the direction of its length with respect to the shell 30 since, at the opposite end of the first span, the second span 16 is guided along the wall of the mould by means of the free space 17 left by the layer of varnish, eliminated during the dewaxing of the mould.

In addition, the surfaces of the second span 16—here the horizontal surface 16B—that are not parallel to the axis of progression of the solidification, by virtue of the free space 18 formed by the depositing of wax, do not come into contact with the wall of the shell. In this way the stressing of the core is avoided. Typically, the thickness of this space corresponding to the depositing of wax is approximately one millimetre for components having a length of 100 to 200 mm, that is to say approximately 1% of the length of the component. By not being stressed the core is not liable to be buckled and the initial wall thicknesses of the component between the wall of the mould and the core are preserved.

Once the metal has cooled, the mould is broken and the components are extracted and sent to the finishing workshop.

The invention claimed is:

1. A method for manufacturing, using lost-wax casting, a metal component with a columnar or monocrystalline structure with at least one elongate-shaped cavity, comprising the steps of:

producing a wax model of the component with a ceramic core corresponding to said cavity, the ceramic core comprising a first holding span at a longitudinal end and a second holding span at an opposite end;

producing a shell mold around the wax model, the shell mold comprising a base, the first holding span of the ceramic core being on the same side as the base of the shell mold;

eliminating the wax by dewaxing the shell mold;

placing the shell mold in a furnace, the base being placed on a hearth of the furnace;

pouring a molten alloy into the shell mold;

solidifying the poured molten alloy by gradual cooling from the hearth in a propagation direction, wherein, during the step of producing the wax model, the second holding span comprises first surfaces that are not parallel to said propagation direction, and second surfaces that are parallel to said propagation direction;

wherein, during the step of producing the wax model, the first surfaces are covered initially by a deposit of wax, and the second surfaces, which are not covered initially and previously by a deposit of wax, are directly and integrally coated by a layer of varnish, said layer of varnish having a thickness of between 3 and 5 hundredths of a millimeter;

wherein the ceramic core is secured to the shell mold by an anchor between the first span of the ceramic core and an internal wall of the shell mold;

wherein the second span of the ceramic core is slidably held in said internal wall of the shell mold by said layer of varnish;

wherein, during and after the step of producing the shell mold, said layer of varnish prevents said internal wall of the mold from sticking to the ceramic core in said second surfaces, wherein, after the step of producing the shell mold, said second surfaces come into contact with said internal wall of the mold through said layer of varnish;

wherein, during the step of dewaxing the shell mold, said layer of varnish is eliminated from said second surfaces, as well as the wax covering said first surfaces so that a free space is created between the second holding span of the ceramic core and said internal wall of the shell mold;

wherein, during the progression of the solidification of the poured molten alloy, said free space left by the layer of varnish and by the wax is kept so as to prevent the second holding span of the ceramic core from coming into contact with said internal wall of the shell mold when the core expands.

2. The method according to claim 1, wherein said anchor comprises a rod passing through the first holding span and being embedded in said internal wall of the shell mold.

3. The method according to claim 2, wherein said rod is made from ceramic.

4. The method according to claim 1, for manufacturing a plurality of components, the models of said components being collected together in a cluster inside said shell mold.

5. The method according to claim 1, wherein the metal component has a columnar structure.

6. The method according to claim 1, wherein the metal component has a monocrystalline structure.

7. The method according to claim 1, wherein the metal component being a turbine engine blade, the first holding span being in an extension of an apex of a vane of the blade, the second holding span being in an extension of a root of the blade.

8. The method according to claim 1, wherein the hearth is able to move vertically between a hot region where an alloy is molten and a cold region for solidifying the alloy, the hearth itself being cooled.

9. The method according to claim 1, wherein the molten alloy includes a nickel alloy.

10. The method according to claim 1, further comprising cooling the hearth of the furnace.

11. The method according to claim 1, wherein the hearth is configured to provide directional solidification.

12. The method according to claim 1, wherein the deposit of wax has a thickness of approximately 1% of a length of the metal component.

13. The method according to claim 1, wherein after the step of dewaxing, said first surfaces of the second holding span do not come into contact with said internal wall of the shell mold.

14. The method according to claim 1, wherein after the step of dewaxing of the shell mold and eliminating of said layer of varnish, said free space comprises a first space formed by the dewaxing of said first surfaces, and a second space formed by eliminating the layer of varnish from said second surfaces of the second holding span.

15. The method according to claim 14, wherein said second space forms a sliding holding of the second holding span on said internal wall of the shell mold.

16. The method according to claim 15, wherein said sliding holding is a longitudinally guiding of the second holding span along said internal wall of the shell mold, so as to prevent the shell mold from exerting a stress on the ceramic core.

17. The method according to claim 14, wherein said first space left by the wax has a thickness of approximately 1 mm and the metal component has a length of 100 to 200 mm, and said second space left by the layer of varnish has a thickness between 3 and 5 hundredths of a millimeter.

18. The method according to claim 1, wherein the deposit of wax has a thickness of approximately 1 mm and the metal component has a length of 100 to 200 mm.

* * * * *